US012747597B2

(12) United States Patent
Adams

(10) Patent No.: US 12,747,597 B2
(45) Date of Patent: Sep. 29, 2026

(54) DRYWALL HANGING TOOL

(71) Applicant: Edward Adams, Kingsport, TN (US)

(72) Inventor: Edward Adams, Kingsport, TN (US)

( * ) Notice: Subject to any disclaimer, the term of this patent is extended or adjusted under 35 U.S.C. 154(b) by 0 days.

(21) Appl. No.: 18/603,499

(22) Filed: Mar. 13, 2024

(65) Prior Publication Data

US 2025/0290329 A1 Sep. 18, 2025

(51) Int. Cl.
*E04G 25/00* (2006.01)
*E04F 21/18* (2006.01)

(52) U.S. Cl.
CPC ..... *E04F 21/18* (2013.01)

(58) Field of Classification Search
CPC ..... E04F 21/18
See application file for complete search history.

(56) References Cited

U.S. PATENT DOCUMENTS 5,129,774 A * 7/1992 Balseiro ..... E04F 21/1805 248/354.1
5,407,183 A 4/1995 Singeltary
6,161,824 A * 12/2000 Gustavson ..... E04F 21/185 269/904
7,694,464 B2 * 4/2010 Garcia ..... E04F 21/185 52/746.1
8,549,816 B2 * 10/2013 Roberts ..... E04F 21/185 52/DIG. 1
2001/0029715 A1 10/2001 Bradley
2009/0181607 A1 7/2009 Ray, Jr.
2014/0053498 A1 2/2014 Gonzales
2015/0083873 A1 3/2015 Garpow
2019/0055739 A1 * 2/2019 Gross ..... E04F 21/1805

FOREIGN PATENT DOCUMENTS

CA 2999659 4/2018

* cited by examiner

*Primary Examiner* — Amy J. Sterling
(74) *Attorney, Agent, or Firm* — Jerome Drabiak; Di Wu; Edison Law Group, PLLC

(57) ABSTRACT

A Drywall Hanging Tool that is an aluminum-based device designed to facilitate the installation of drywall by a single individual. Shaped like an "L," the tool securely holds one end of the sheetrock while the user attaches the other, mimicking the presence of an extra hand. With simple installation and cost-effective production, this novel invention revolutionizes the process of drywall hanging, making it more accessible and efficient for DIY enthusiasts and construction professionals alike.

12 Claims, 6 Drawing Sheets

DRYWALL HANGING TOOL

BACKGROUND OF THE INVENTION

The Drywall Hanging Tool is a novel device designed to assist individuals in hanging drywall independently without the need for an additional helper. Traditional methods often involve using drywall lifts or makeshift supports like wood and screwdrivers to hold the sheetrock in place during installation. These methods can be time-consuming and require extra hands to ensure proper positioning and attachment. The present subject matter aims to address this problem by providing a convenient and efficient solution for single-person drywall hanging.

SUMMARY OF THE INVENTION

The Drywall Hanging Tool is an aluminum-made device shaped like the letter "L." Its primary function is to hold sheetrock securely in place while the user attaches it to the ceiling or walls. By offering a stable and reliable support mechanism, the present subject matter enables an individual to work on one end of the drywall while the tool holds the other end, simulating the presence of an extra hand. The tool is easy to install, requiring only a few screws for secure placement, and boasts durability, making it a cost-effective and long-lasting solution for DIY drywall installation.

DETAILED DESCRIPTION OF THE INVENTION

The Drywall Hanging Tool serves as a practical and innovative solution to streamline the process of hanging drywall for solo users. Its construction primarily comprises aluminum, providing the necessary strength and lightweight characteristics for easy handling. The tool's distinctive "L" shape allows it to be positioned vertically against the drywall surface, effectively holding one end while the user manages the other end of the sheetrock.

To utilize the present subject matter, the user can secure it to the ceiling or wall by affixing it with a few screws. Once in place, the tool acts as a reliable support, preventing the sheetrock from sagging or falling during installation. This feature proves particularly advantageous when working alone or in scenarios where additional assistance is not readily available.

Notably, the Drywall Hanging Tool has undergone rigorous testing. The successful use of this tool during real-world applications highlights its practicality and efficiency in aiding drywall installation projects.

One significant advantage of the present subject matter is its cost-effectiveness. Manufactured using aluminum, the tool can be produced at a low cost, making it an affordable option for DIY enthusiasts and professionals alike. Moreover, its robust build ensures long-lasting performance, minimizing the need for frequent replacements.

The design of the present subject matter is straightforward and user-friendly, making it accessible to a wide range of users, including homeowners and construction professionals. Its intuitive installation process requires no specialized skills, allowing individuals with basic DIY knowledge to handle drywall hanging tasks with ease.

In terms of appearance, the Drywall Hanging Tool resembles a strut with an "L" shape. This simplistic yet functional design contributes to its practicality and effectiveness in supporting drywall during installation.

The invention comprises multiple embodiments, offering variations in design and features. The inventor has developed four distinct models of the present subject matter, catering to diverse preferences and requirements in drywall hanging.

Comparing the Drywall Hanging Tool to prior art, such as U.S. Pat. No. 5,407,183, US 2014/0053498, US 2001/0029715, US 2015/0083873, and US 2009/0181607, it stands out as a novel and unique solution. While some prior art documents discuss related inventions, the present subject matter's specific design, material composition, ease of use, and cost-effectiveness distinguish it from the existing patents and patent publications.

Figure 1:
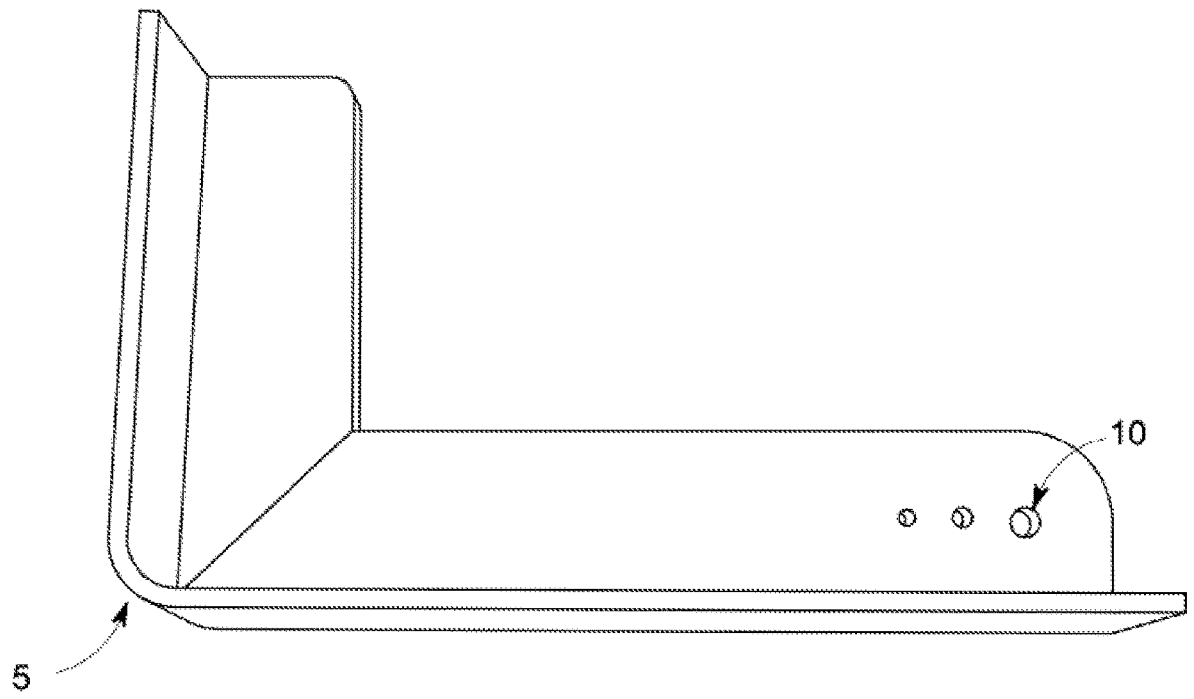
FIG. 1 shows a side perspective view of the base piece of dry wall hanging tool.

FIG. 1 shows a side perspective view of the base piece of dry wall hanging tool wherein the base piece comprises of a vertical and horizontal surface with a 90-degree bend 5 and a plurality of holes 10 for securing the base piece to drywall, framing, or adjusting pieces.

Figure 2:
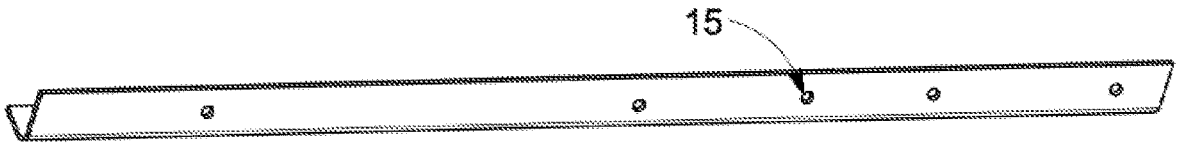
FIG. 2 shows a side perspective view of the adjusting piece of the dry wall hanging tool.

FIG. 2 shows a side perspective view of the adjusting piece of the dry wall hanging tool wherein the adjusting piece comprises of a vertical and horizontal surface with a plurality of holes 15 for securing the adjusting piece to drywall, framing, or base pieces.

Figure 3:
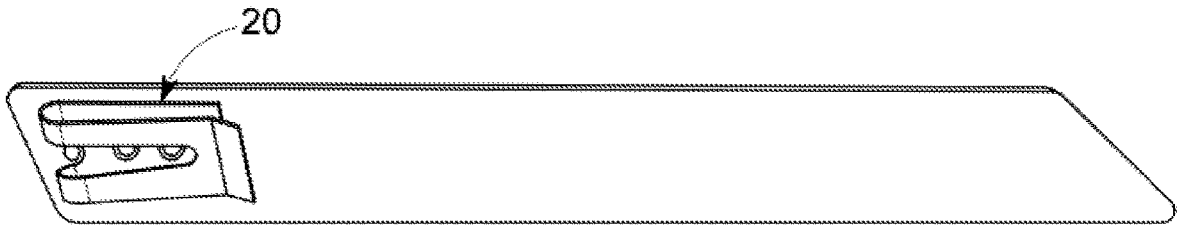
FIG. 3 shows a perspective view of the clip affixed to the dry wall hanging tool.

FIG. 3 shows a perspective view of the clip affixed to the dry wall hanging tool wherein the clip 20 is designed to hold additional tools, tool bags, or other items to make the drywall hanging process easier.

Figure 4:
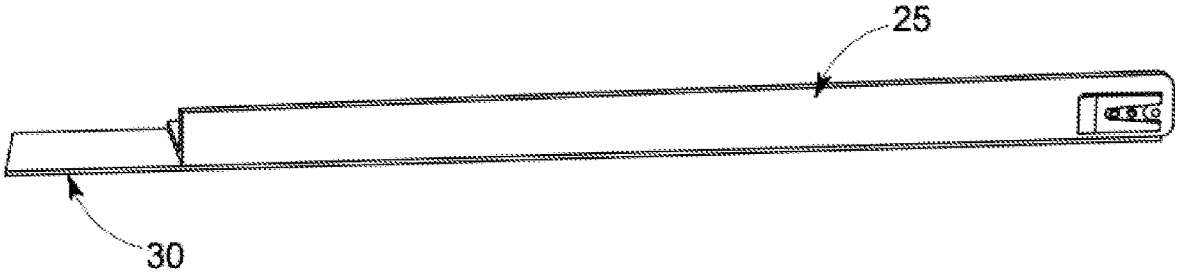
FIG. 4 shows a side view of the base piece with the adjusting piece of the dry wall hanging tool.

FIG. 4 shows a side view of the base piece with the adjusting piece of the dry wall hanging tool wherein the base piece 25 has a clip affixed to it and the adjusting piece 30 is removably affixed to the base piece.

Figure 5:
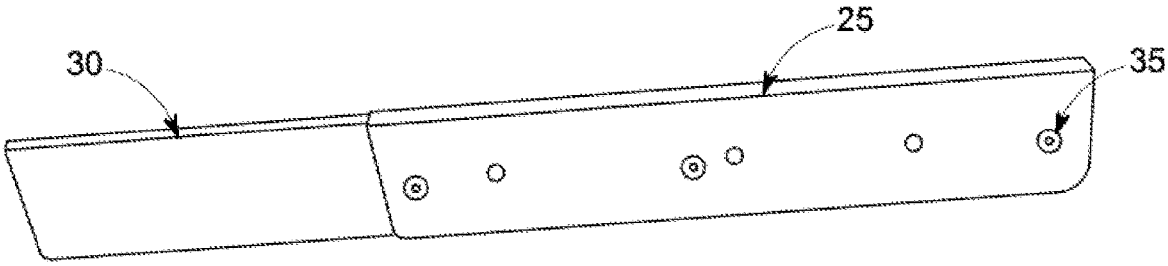
FIG. 5 shows a portion of the base piece and adjusting affixed to one another.

FIG. 5 shows a portion of the base piece and adjusting affixed to one another wherein screws 35 affix the base piece 25 and adjusting piece 30 through a plurality of holes to drywall or framing.

Figure 6:
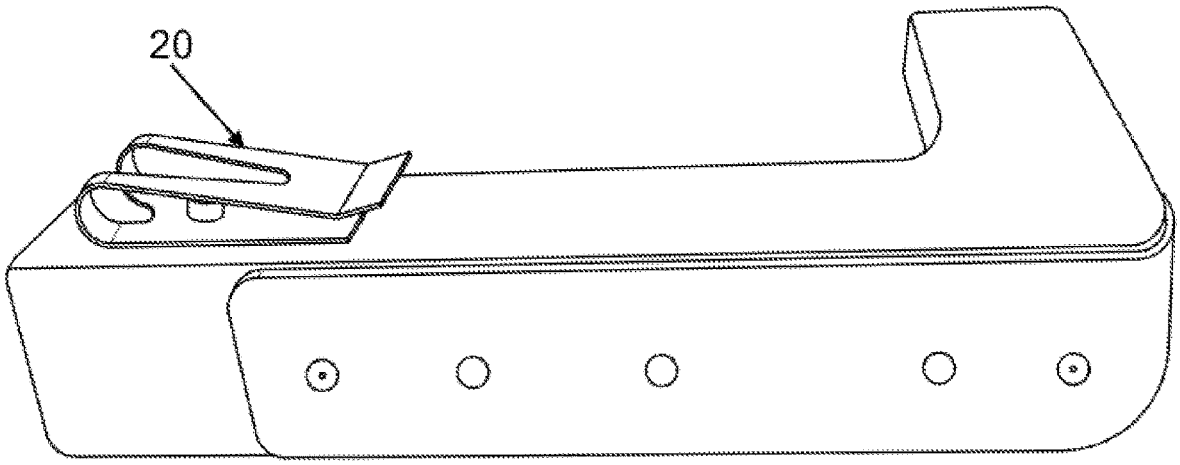
FIG. 6 shows an end view of two base pieces affixed to each other.

FIG. 6 shows an end view of two base pieces affixed to each other wherein one base piece is the embodiment with the clip and the other is an embodiment without the clip.

Figure 7:
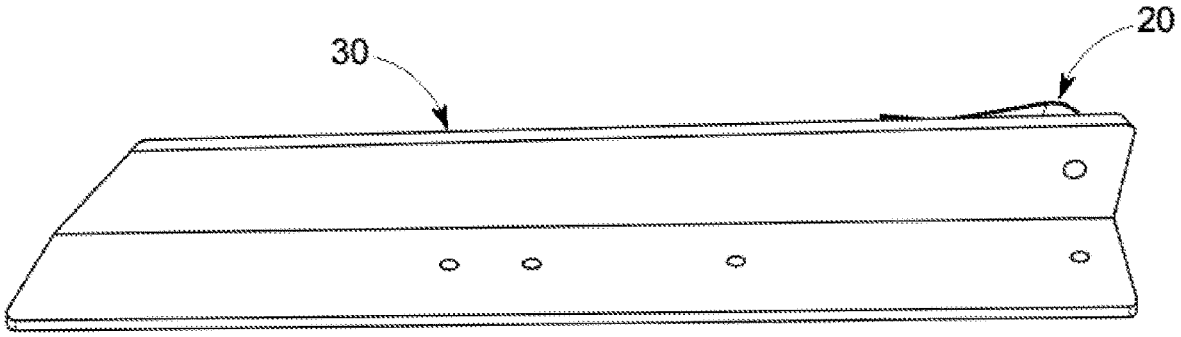
FIG. 7 shows the interior of an adjusting piece of the dry wall hanging tool.

FIG. 7 shows the interior of an adjusting piece of the dry wall hanging tool wherein clip 20 is affixed to the exterior of the adjusting piece 30.

Figure 8:
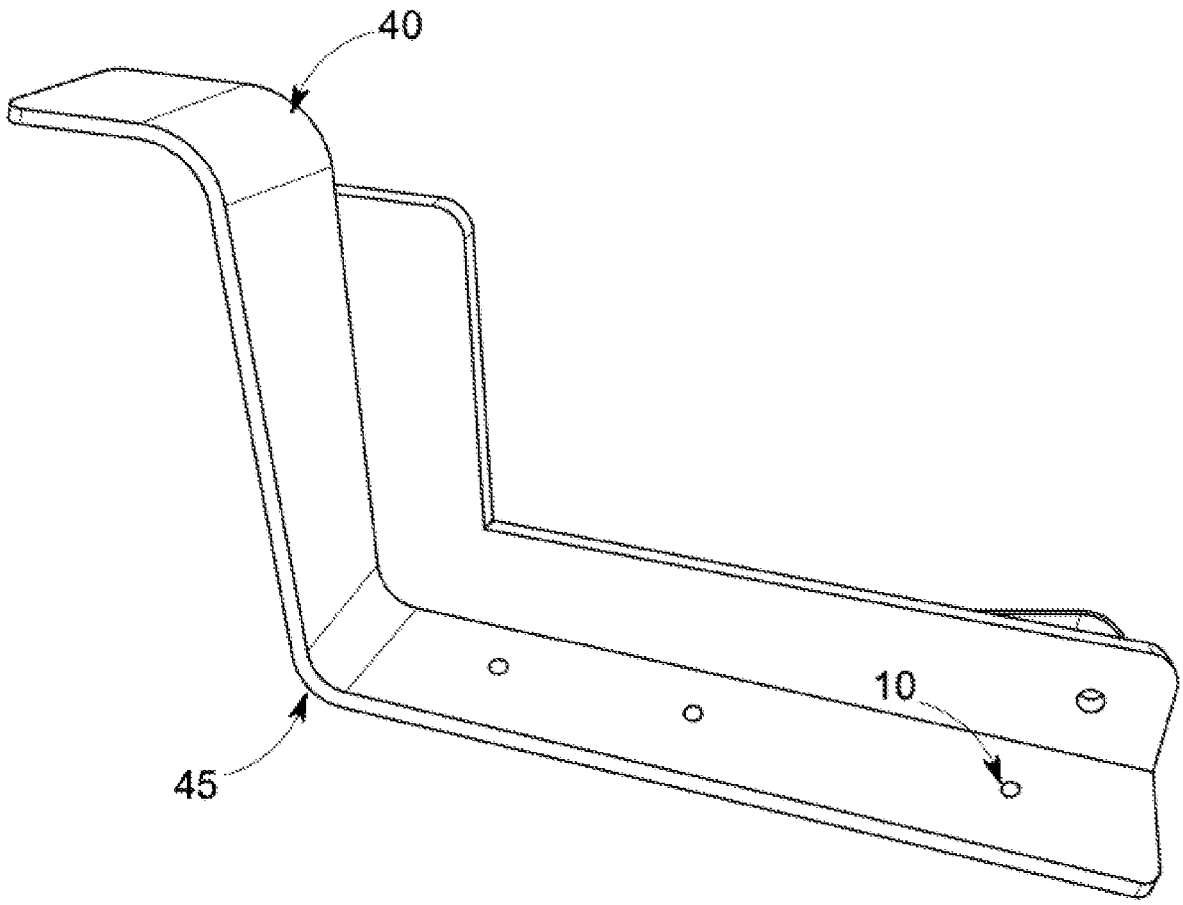
FIG. 8 shows an interior perspective view of a multi-bend embodiment of a base piece of the dry wall hanging tool.

FIG. 8 shows an interior perspective view of a multi-bend embodiment of a base piece of the dry wall hanging tool wherein the two bends (40, 45) provide additional support for hanging drywall. The multi-bend embodiment also comprises of a vertical and horizontal surface with a plurality of holes 10 to be removably affixed to adjusting pieces, drywall, or framing. The multi-bend embodiment also has a clip on the exterior vertical surface.

Figure 9:
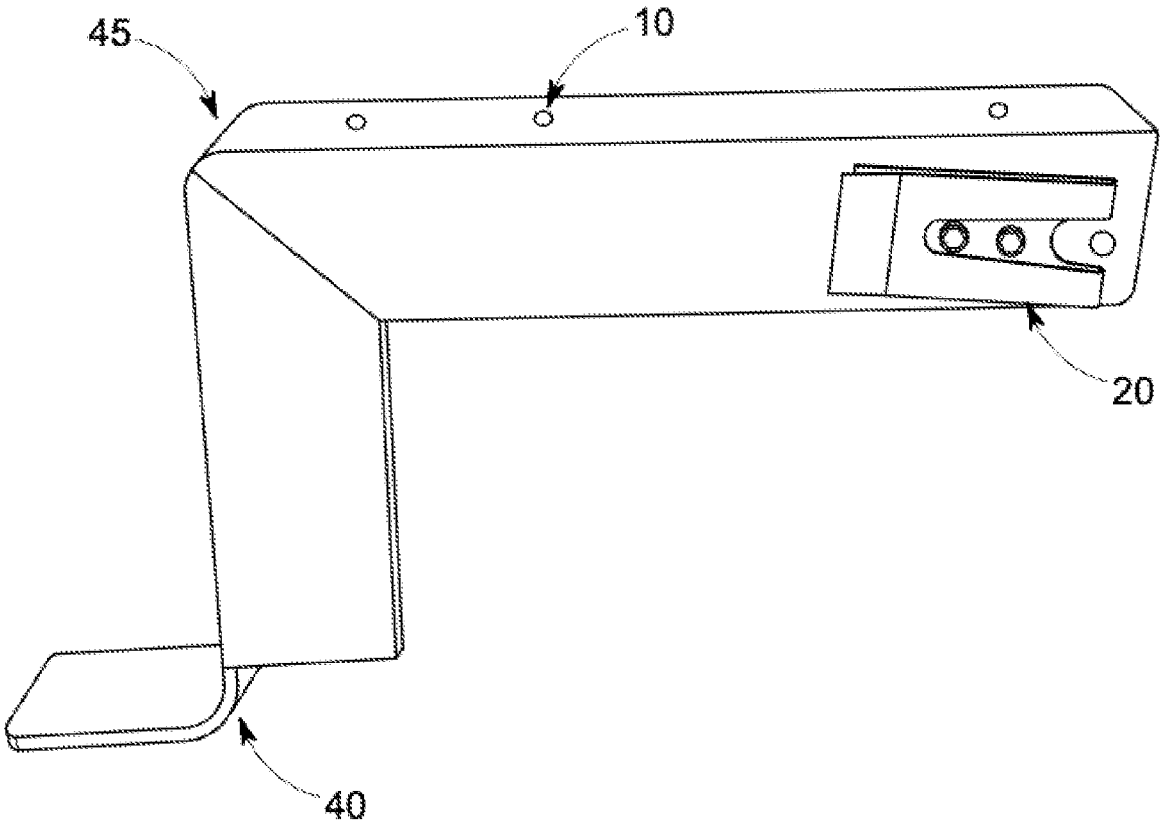
FIG. 9 shows an exterior perspective view of a multi-bend embodiment of a base piece of the dry wall hanging tool.

FIG. 9 shows an exterior perspective view of a multi-bend embodiment of a base piece of the dry wall hanging tool wherein the two bends (40, 45) provide additional support for hanging drywall. The multi-bend embodiment also comprises of a vertical and horizontal surface with a plurality of holes 10 to be removably affixed to adjusting pieces, drywall, or framing. The multi-bend embodiment also has a clip 20 on the exterior vertical surface.

The invention claimed is:

1. A drywall hanging tool adapted and configured for enabling a user to position and attach a sheet of drywall to a ceiling or a wall wherein the drywall hanging tool comprises: a base piece (25), an adjusting piece (30) removably affixed to the base piece (25), and a clip (20) affixed to the adjusting piece (30), wherein one end portion of the drywall hanging tool is adapted and configured for securely holding one end portion of a sheet of drywall, and wherein an other end portion of the drywall hanging tool is adapted and configured for enabling a user to position and attach a sheet of drywall to a ceiling or a wall, wherein the one end portion of the sheet of drywall is distally spaced from the other end portion of the sheet of drywall.

2. The drywall hanging tool of claim 1, wherein the base piece (25) defines a vertical surface and a horizontal surface including a 90-degree bend (5) between the vertical and horizontal surfaces, and a plurality of holes (10) for enabling the base piece (25) to be secured to a sheet of drywall, a framing, or another base piece.

3. The drywall hanging tool of claim 1, wherein the adjusting piece (30) defines a vertical surface and a horizontal surface including a plurality of holes (15) for enabling the adjusting piece (30) to be secured to a sheet of drywall, a framing, or at least one other base piece.

4. The drywall hanging tool of claim 1, wherein the clip (20) is configured to hold additional tools, associated tool bags, or other items configured for enabling a process for hanging a sheet of drywall to be easier for a user of the drywall hanging tool than would otherwise be experienced.

5. The drywall hanging tool of claim 1, further including a plurality of screws (35) adapted and configured for removably affixing the base piece (25) and the adjusting piece (30) to a sheet of drywall or a framing.

6. The drywall hanging tool of claim 1, the base piece (25) is affixed to another clip.

7. A dry wall drywall hanging tool comprising: a base piece defining a pair of spaced-apart bends (40, 45), wherein the base piece is adapted and configured for removably affixing one or more adjusting pieces, a sheet of drywall, a framing, and/or a clip thereto, wherein the base piece defines spaced-apart end portions, wherein the bends (40, 45) are adapted and configured to cause the end portions of the base piece to be directed in opposite directions in relation to each other.

8. The drywall hanging tool of claim 7, wherein the base piece defining the bends (40, 45) defines a vertical surface and a horizontal surface defining a 90-degree bend and a plurality of holes, wherein the drywall hanging tool includes a plurality of screws (35), wherein each one of the plurality of screws (35) is sized and configured to be securely disposed through an associated one of the plurality of holes, for hanging a sheet of drywall.

9. The drywall hanging tool of claim 7, wherein the clip is configured to hold additional tools, associated tool bags, or other items configured for enabling a process for hanging a sheet of drywall to be easier for a user of the drywall hanging tool than would otherwise be experienced.

10. The drywall hanging tool of claim 7, wherein the one or more adjusting pieces are removably affixed to the base.

11. The drywall hanging tool of claim 7, wherein a plurality of screws are used to removably affix the base piece defining a pair of spaced-apart bends (40. 45) and the adjusting piece to a sheet of drywall or a framing.

12. The drywall hanging tool of claim 7, wherein the bends (40, 45) each define an approximately 90-degree angle, whereby each bend provides additional support for hanging a sheet of drywall.

* * * * *